United States Patent [19]

Polidoro

[11] 4,359,251

[45] Nov. 16, 1982

[54] FOLDING SHELF CABINET

[76] Inventor: Albert V. Polidoro, 18 E. Gen. Robinson St., Pittsburgh, Pa. 15212

[21] Appl. No.: 113,697

[22] Filed: Jan. 21, 1980

[51] Int. Cl.[3] ..... A47B 77/10; A47F 5/08

[52] U.S. Cl. ..... 312/245; 312/313; 312/223

[58] Field of Search ..... 312/214, 223, 245, 246, 312/247, 257 R, 257 S, 313

[56] References Cited

U.S. PATENT DOCUMENTS

| | | | |
|---|---|---|---|
| 2,939,755 | 6/1960 | Wyant | 312/245 |
| 3,404,930 | 10/1968 | Cafiero et al. | 312/313 |
| 3,429,630 | 2/1969 | Katz | 312/245 |
| 3,466,106 | 9/1969 | Johnson | 312/245 |
| 3,661,435 | 5/1972 | Miller | 312/223 |

*Primary Examiner*—Victor N. Sakran

*Attorney, Agent, or Firm*—Weiser, Stapler & Spivak

[57] ABSTRACT

A cabinet defining an interior space which may be optionally enclosed by a pivotally attached cover is disclosed. To the ends of the pivotally attached cover are connected brackets which include L-shaped slots. A shelf is provided which includes finger-tipped rods attached to its underside. The finger tipped rods are inserted within the L-shaped slots to allow the shelf to slide and pivot among three positions about the cabinet, namely, a first position vertically oriented above the cabinet, a second position horizontally oriented above the cabinet and a third position vertically oriented alongside the cabinet. The cover is supported when in an open position by a spring latch carried within the cabinet. The shelf is supported in its second horizontal position above the cabinet by hinged braces provided on the shelf underside, the brace being adapted to fit through slots in the cover and within holders arranged within the cabinet.

10 Claims, 20 Drawing Figures

FOLDING SHELF CABINET

SUMMARY

The present invention relates to improvements in a folding shelf supported by a cabinet on a wall, and it is a primary object of this invention to provide a device of the character hereafter described, which is a sturdy, compact, portable folding shelf cabinet, and is provided for quick attachment and economical utilization.

Another object is to provide a safe, lightweight, decorative folding shelf cabinet for storing small radios and the like, and for the optional utilization of an electric fluorescent lamp within the cabinet, and for storing books and the like atop the folding shelf, and for storing small books and the like within a shelf having compartments and being un-foldable and foldable, with the same cabinet.

Other objects, and novel features of this invention should be apparent as to the following description, in reference to the drawings:

SPECIFICATION

Figure 1:
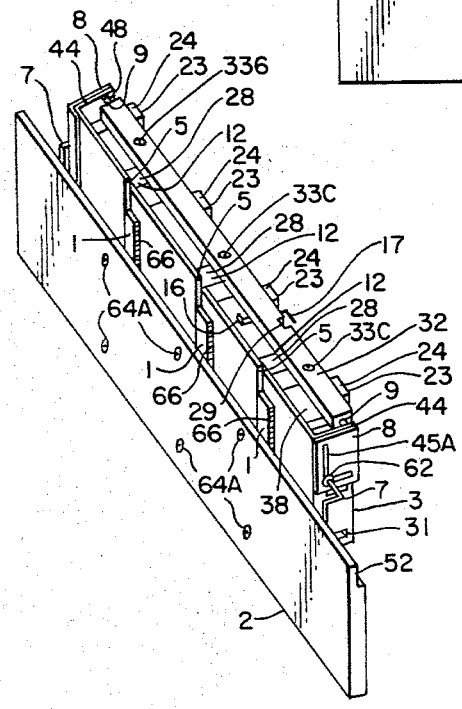
FIG. 1 is a left view of the folding shelf cabinet, with the shelf and braces in a vertically folded position.

The present folding shelf cabinet (4) co-operatively supports a folding shelf (2) in a horizontally extended position, for use, and cabinet (4) being simultaneously co-operative with the cover (3) and shelf (2). The cover (3) supports shelf (2) while the same shelf is in a swung downward; vertically folded position; as illustrated in FIG. 1. Cabinet (4) having apertures (6) formed in the rear wall (19), for mounting on a wall or vertical support, and having vertical walls (20). One of the walls (20) being formed on each outermost end of horizontal, narrow top wall (21), and to a bottom wall (22).

Figure 2:
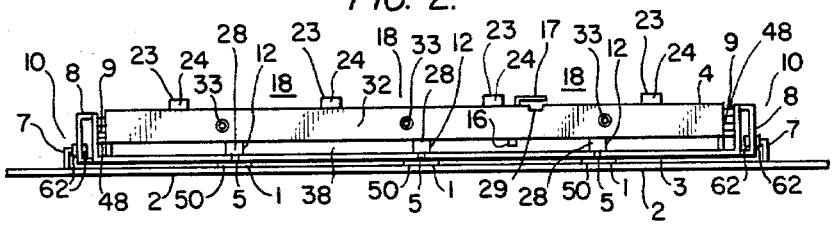
FIG. 2 is a top view of the shelf and braces folded.
Figure 3:
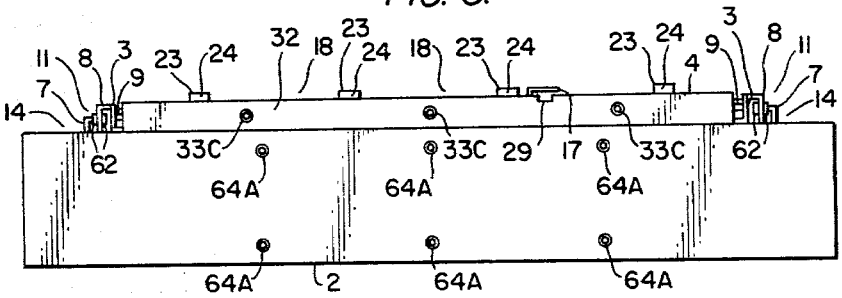
FIG. 3 is a top view of the shelf and braces un-folded.
Figure 4:
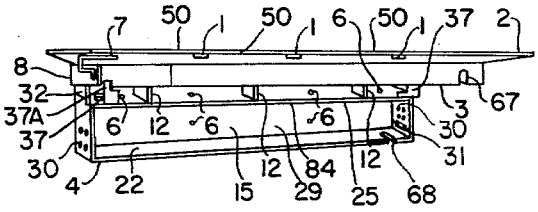
FIG. 4 is a right elevation view of the cabinet with the cover, open.
Figure 6:
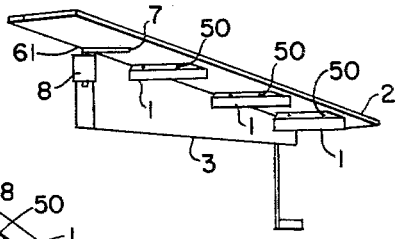
FIG. 6 illustrates the folding shelf cabinet with the support braces un-folded in combination with the attached cabinet and cover.
Figure 5:
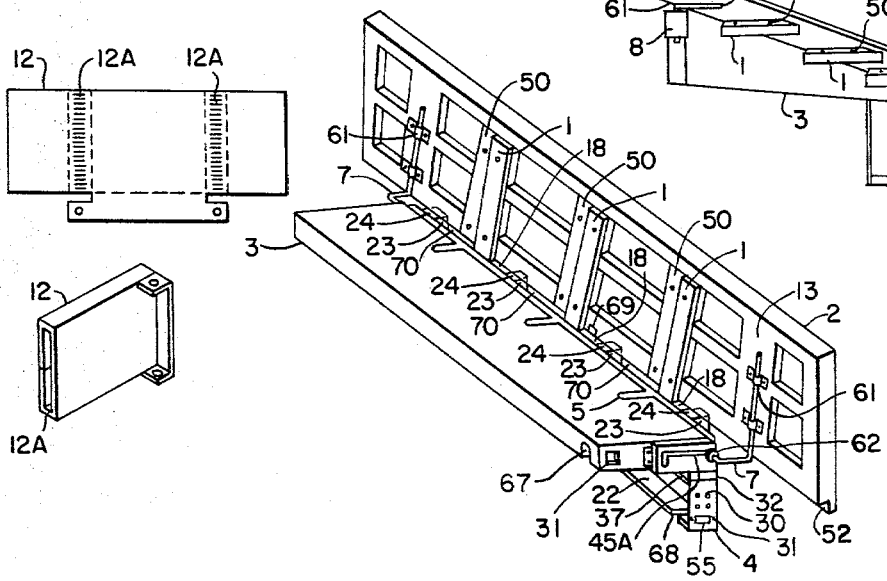
FIG. 5 is a left elevation view with the shelf in a vertically folded position; and illustrates the metal blank from which the holders are formed.
Figure 7:
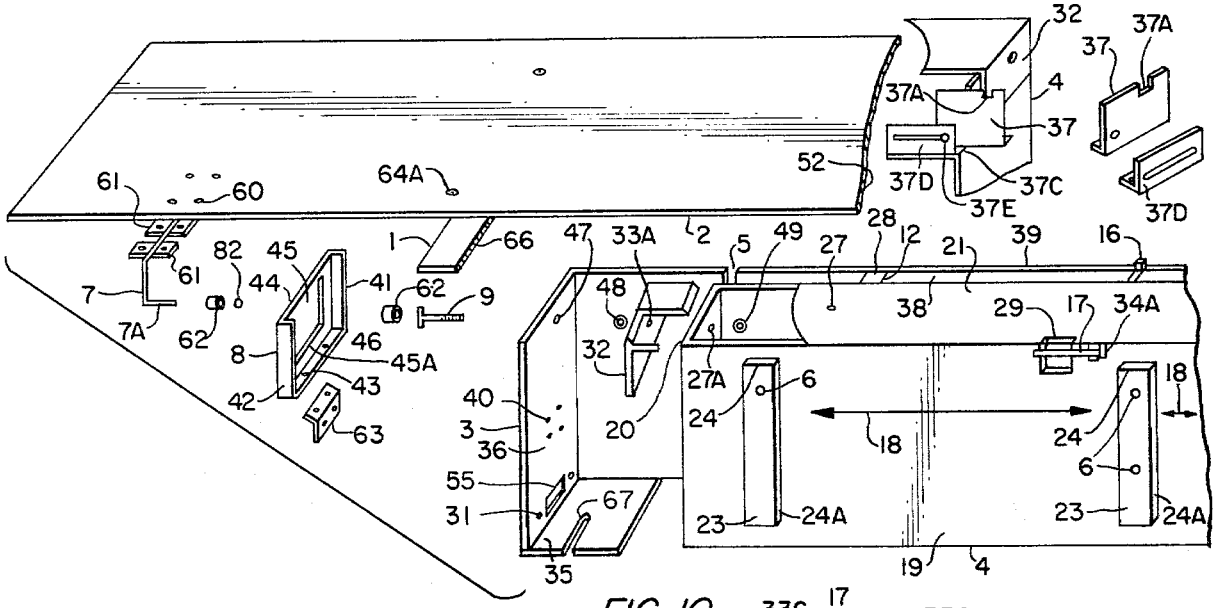
FIG. 7 illustrates the order of assembly of the folding shelf cabinet.
Figure 8:
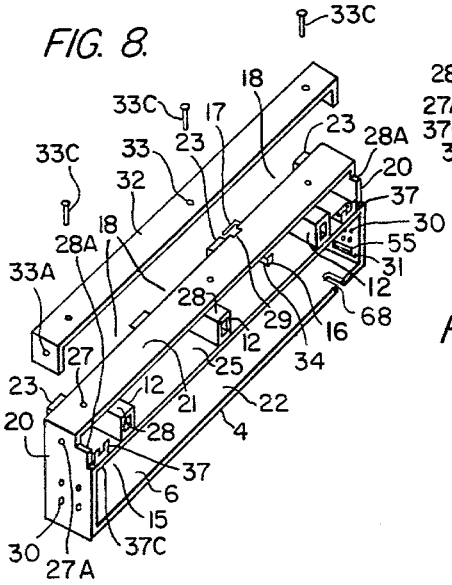
FIG. 8 illustrates the shelf supporting cabinet.
Figure 10:
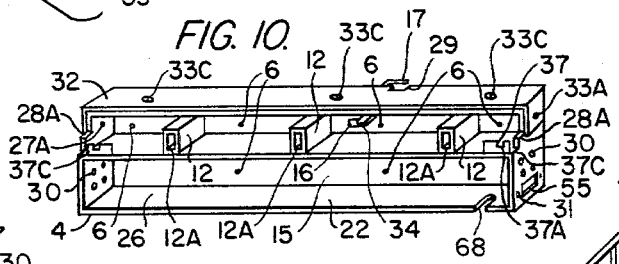
FIG. 10 illustrates the brace holders mounted on a shelf within the cabinet.
Figure 12:
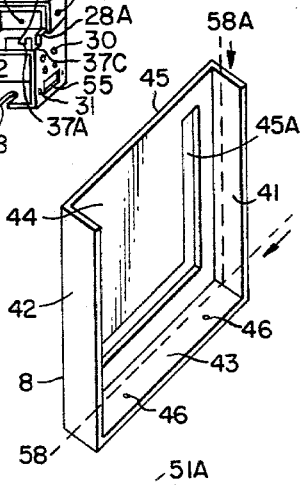
FIG. 12 illustrates the same bracket as in FIG. 11.
Figure 11:
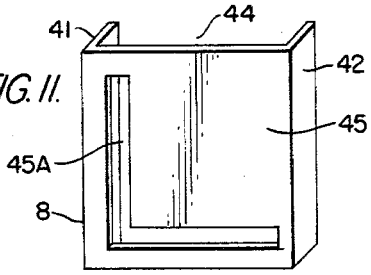
FIG. 11 is a view of a modified form of bracket having a slot formed partially vertical and partially horizontal.
Figure 9:
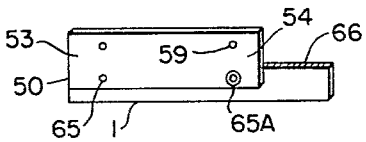
FIG. 9 shows flexible material secured on a support brace; and transverse grooves formed on the inner end part of the brace.
Figure 13:
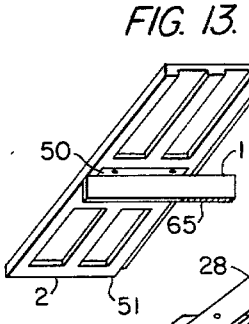
FIG. 13 illustrates a space shown by dashed line 51—51 whereby the inner lengthwise edge of the shelf fits contacting the top lengthwise edge forward of the cabinet and the part of the shelf adjacent the inner lengthwise edge of the bottom surface of the shelf being adjacent the top lengthwise edge of the cover having clearance space.
Figure 15:
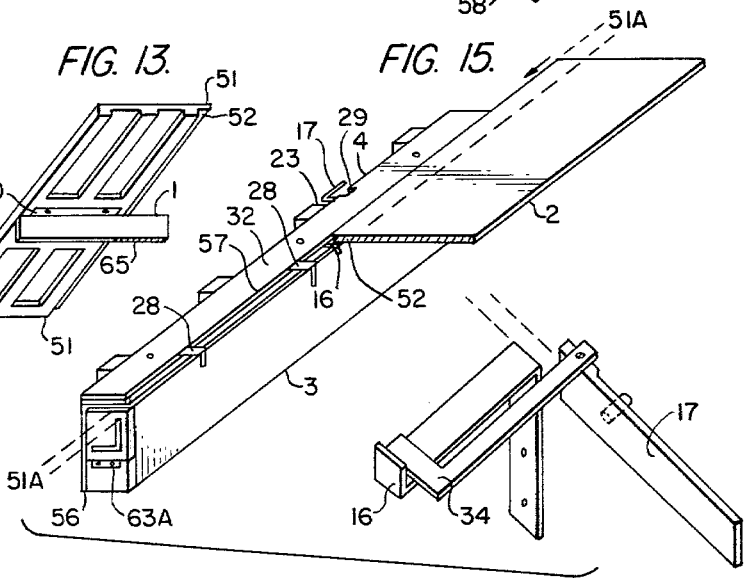
FIG. 15 shows the inner part adjacent the inner lengthwise edge of the shelf fitting atop the brace holders indicated on line 51—51 of FIG. 13.
Figure 14:
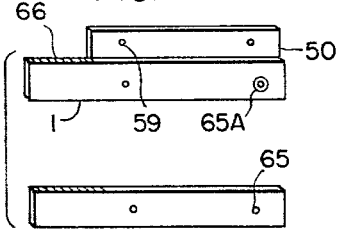
FIG. 14 illustrates the surface of the flexible material affixed contacting the bottom of the shelf so that the flexible material partially folds the braces by resiliency and shown in FIG. 13.
Figure 16:
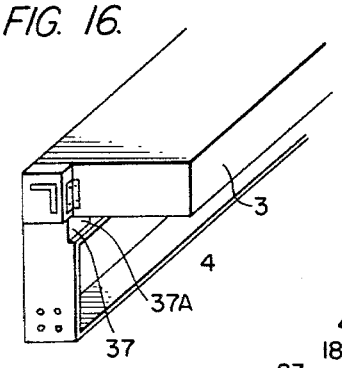
FIG. 16 illustrates one of the latches supporting the cover of the cabinet in a horizontally extended position.
Figure 17:
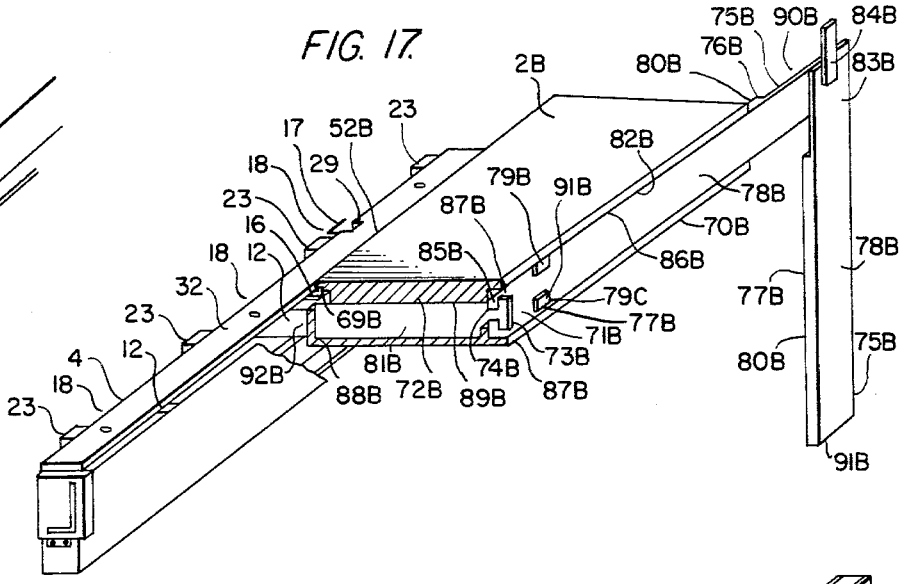
FIG. 17 is a section view showing, in combination: the slidable cover open, adjacent an outermost end of the compartments and shelf.
Figure 18:
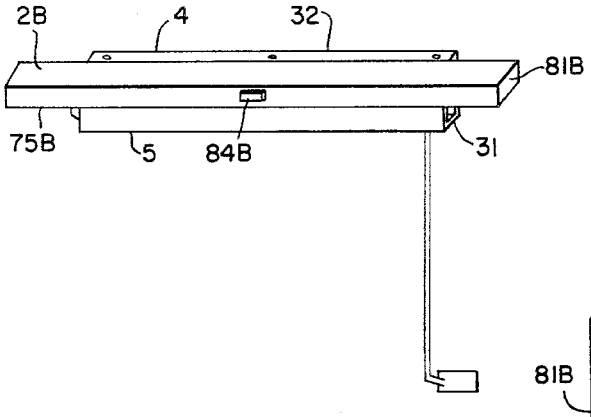
FIG. 18 is a view of the cabinet and shelf, in combination.
Figure 19:
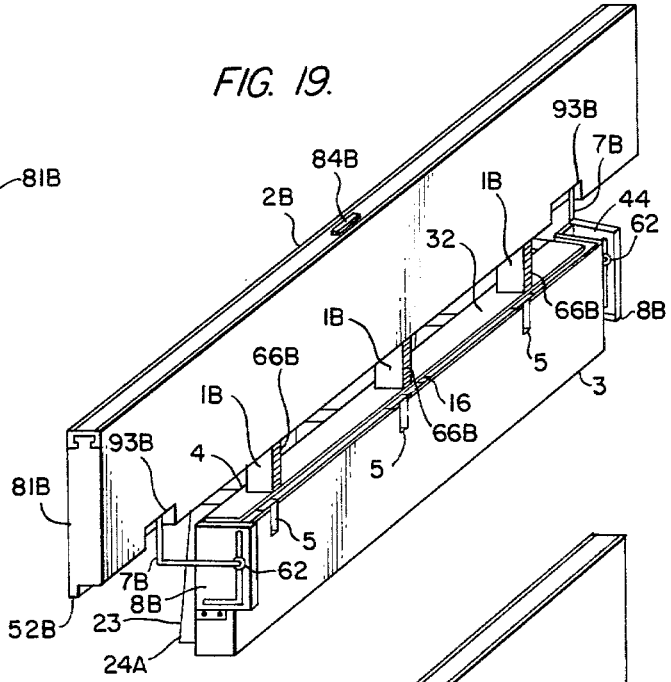
FIG. 19 illustrates the shelf and compartments in combination, and in a vertically swung position atop the cabinet before the cover is opened.
Figure 20:
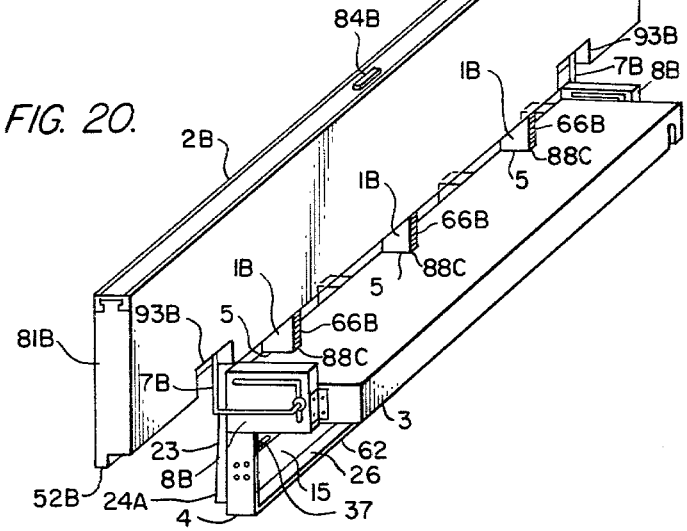
FIG. 20 shows the cabinet cover supporting the shelf and compartments in combination, atop the cabinet, in a vertically folded position. The cover support latches are not shown, as in FIG. 16.

Wall (22) being the same width as side walls (20) at lower portions thereof. Wall (21) being in alignment, lengthwise, with the top rear lengthwise edge of cabinet (4), so that a clearance space (38) is comprised adjacent the forward lengthwise edge of top wall (21), for clearing the inner lengthwise edge of shelf (2). A clearance space (28A) is formed in the upper forward edges of side walls (20), and a clearance space (37C) is formed extending downwardly to inner shelf (25) in walls (20). The upper part within cabinet (4) comprises shelf (25) for storing small radios and the like, and extends from wall (20) to the opposite wall (20), and from rear wall (19), across the width of the cabinet, and being in alignment with the lower vertical edges of side walls (20). Holders (12), of metal construction, formed from metal blanks, as shown in FIG. 5, and of suitable thickness, or other suitable material can be used, are in alignment with apertures (27) and the forward lengthwise edge of shelf (25) and secured by rivets to top wall (21). The lower ends of holders (12) are secured to shelf (25) by screws, or other method of securing can be used. For cooperativeness with the shelf (2), while being folded and unfolded, this invention consists of the forward projecting parts of holders (12) comprising ledges (28) slightly forward of top wall (21) so that the inner lengthwise edge parts of shelf (2) traverse the clearance space (38) atop ledges (28) and the tops of ledges (28A) of walls (20). This invention comprises posts (23) for cooperativeness with cabinet (4), the cover (3) and shelf (2), and are vertically positioned and formed on the rearward surface of back wall (19) of the cabinet (4). The length of each post (23) being less than the height of cabinet (4) so that the ends of the posts are adjacent the top and bottom lengthwise edges of wall (19), so that the tops of the posts comprise ledges (24), and each post being intervally spaced. The posts (23) comprise lower portions of more depth than the upper parts of the same posts, for slightly inclining cabinet (4) in combination with the base of the posts consisting of more thickness (24A) of the material of construction than the upper parts of the posts, so that the top parts of the posts provide clearance space, enough, through which, the upper parts of the posts can contact the mounting wall and thereby slightly inclining the cabinet (4) and shelf (2), simultaneously, when the same cabinet is mounted on a wall. Spaces (18) are comprised between posts (23)

as access for clearing the downwardly projecting inner end parts of the braces (1) after the same braces are folded, so that the vertically positioned braces support shelf (2) in a vertically folded position atop cabinet (4). Ledges (24) of the posts (23) provide clearance for, and simultaneously support the inner lengthwise edge (52) of shelf (2) as illustrated in FIG. 5 in the drawing, and indicated on line 51A,51A in the drawing of FIG. 15. The space (15) directly below shelf (25) within cabinet (4) provides for the optional utilization of an electric lamp, such as fluorescent. A central part of walls (20) consist of apertures (30) for mounting holders (not shown) within cabinet (4) for holding a fluorescent lamp. One wall (20) having apertures (31) for mounting an electric switch, and having an electric switch access slot (55) formed therethrough, for clearance of the switch. Cabinet (4) is preferably made of molded rigid plastic of enough thickness, or other suitable material can be used. The present invention comprises a semiframe (32) made preferably of metal of enough thickness, for cooperativeness with the cabinet (4), cover (3) and shelf (2), and for reinforcing the top wall (21) to resist bending upwardly, as well as for reinforcing pivotal access apertures (27A) comprised adjacent the top edges in the central part of the side walls (20) of cabinet (4), (for mounting a pivotal cover (3), described in this description), and comprises apertures (33) formed in series starting adjacent a first end portion comprised of a pivotal access aperture (33A), and a same pivotal access aperture (33A) comprised adjacent the opposite end of the semiframe, whereby parts of the semiframe (32) innermost of the ends, comprise a bend so that these parts of the semiframe extend vertically downward and fit onto the upper part of the side walls (20) of cabinet (4). The apertures (33) are thereby aligned with apertures (27) in the top wall (21) of cabinet (4). The semiframe (32) having the same width as top wall (21) and being in alignment with the lengthwise edges of top wall (21) and whereby the inner lengthwise edge of the semiframe (32) in a part thereof comprises a formed slot (not shown by reference number) in a part of the inner lengthwise edge of the semiframe, and being part of a slot formed in a part of the inner lengthwise edge of top wall (21), and the same slot in top wall (21) being in alignment with a slot formed in the adjacent part of the top lengthwise edge of rear wall (19) of the cabinet (4) whereby the rear wall (19) is formed continuous and projecting a slight distance within cabinet (4) thereby being the walls of slot (29), best illustrated in FIG. 7. The semiframe (32) fits onto the top surface parts of cabinet (4) and thereby secured by rivets (33C) in access apertures (33) and apertures (27) therethrough. Cabinet (4) is comprised of pivotal cover (3) pivotally mounted to a central upper part of the side walls (20) of the cabinet, for opening and closing of the cover (3). The forward lengthwise edge of the semiframe (32) being in alignment with the forward lengthwise edge of the top wall (21) of cabinet (4) so that the inner lengthwise edge of shelf (2) contacts the forward lengthwise edge of the semiframe (32) whereby the shelf (2) is in alignment in the un-folded, supported, horizontally extended position. The present cover (3) of this invention, consists of side walls (36). One wall (36) is formed vertically connected on each outermost end of bottom wall (35) and to the forward wall (39) of the cover (3). The cover (3) having an open top whereby a clearance space (38) is provided so that the top lengthwise edge of the forward wall (39) of cover (3) clears the top forward lengthwise edge of cabinet (4) as the cover is pivotally swung open to a horizontal position and so that the same cover fits the top part of the cabinet (4) whereby the top lengthwise edge portions of the forward wall (39) of the cover (3) are swung directly above the top surface of the cabinet, and not contacting the top surface thereof, so that a clearance space (38) is comprised between the forward wall of the cover (3) and the top surface of the cabinet (4), as the cover (3) is in a horizontally extended position. Reference numeral (57) in FIG. 7 illustrates the top edge of the cover (3) in alignment with the top edges of holders (12). When cover (3) is in closed position, the cabinet (4) fits within the closed cover, as shown by reference numeral (56) in FIG. 1. The top surface of the semiframe (32) and the inner portion of rods (7), brackets (8) and posts (23), are left un-covered while shelf (2) is in a horizontally extended position, as shown in FIGS. 3, 6, 17, in this description. The cover (3) comprises an electric switch access slot (31) formed in a lower portion of one of the side walls (36). The forward wall (39) of cover (3) comprises vertical slots (5) formed starting in the top lengthwise edge, and each slot extending downwardly to a distance terminating slightly more than the width of and to fit the braces (1) while the braces are in a vertically unfolded position within slots (5). Each slot (5) having a closed lower end and an open top. An inner part of, and adjacent, the top edges of side walls (36) of cover (3) comprises pivotal access apertures (47) formed therethrough. The bottom wall (22) of the cabinet (4) comprises a formed slot (68) as an optional electrical extension wire clearance slot, and being in alignment and cooperative with formed slot (67), for the same wire clearance and comprised in bottom wall (35) of cover (3), and illustrated in FIGS. 4, 5, 8, 10. The slot (67) being of enough depth so that the cover (3) can be closed without bending the optional, electrical extension wire as shown in FIGS. 4, 5, 7, and in FIG. 18, whereby cover (3) is in closed position and cooperative with the same wire. The cover (3) is pivotally mounted to side walls (20) of cabinet (4) at an upper part of the same walls, by bolts (9), washers (48) of enough thickness, and threaded nuts (49). Although bolts (9) having a threaded portion can be used, other means for pivotally securing the cover (3) to cabinet (4) through pivotal access apertures (47, 33A, 27A) and washers (48), may be used, such as: rivets of enough length and thickness, thus effecting quicker and more economical assembly of the present folding shelf cabinet. Washers (48) providing enough clearance space between cabinet (4) and cover (3) for un-obstructing the pivotal cover. Brackets (8) having apertures (46) as access for mounting brackets (8) onto the outer surface of side walls (36) of cover (3). Each bracket (8) being comprised of a narrow bottom wall (43), a vertically formed narrow forward wall (41), a vertically formed narrow rear wall (42), a side wall (45), and an open top, whereby, this open top comprises access clearance space (44) for adjusting the innermost threaded bushings (62) while also, adjusting the outermost threaded bushings (62) on rods (7), to move shelf (2) a slight distance to either side as shelf (2) carries the braces (1) into realignment with slots (5) and holders (12), when readjustment of shelf (2) is necessary. The side walls (45) of brackets (8) comprise vertical parts of slots (45A), formed adjacent the vertical forward edge of each bracket (8) and a horizontal part of slots (45A) formed adjacent the bottom lengthwise edge of side walls (45), both parts are formed in series continuity, thus comprising single slots (45A) having a corner in alignment with, and, adjacent the bottom forward corners of walls (45), and both parts of the slot having closed ends. The brackets (8) are preferably made of molded rigid plastic of enough thickness, or other suitable material may be used, and are secured outermost onto the side walls (36) of cover (3) by rivets, best shown in FIG. 13, in apertures of brackets (63), and apertures (40) in side walls (36) of cover (3) therethrough. The cover (3) is preferably made of molded rigid translucent plastic. A novel feature of this invention, being the cover (3) of cabinet (4), comprised cooperative in various positions, simultaneously, while in use, in combination with cabinet (4) and shelf (2). The shelf (2) having side end parts (14) extending a slight distance beyond the sides of cabinet (4) and cover (3). The shelf (2) is preferably made of molded rigid plastic having enough thickness, or other suitable material can be used, comprises a series of rectangular, foldable braces (1) made of the same material as that of shelf (2) and of enough thickness, and are positioned in parallel having the inner end part of each brace (1) transversely extending a proportional distance for cooperativeness beyond the inner lengthwise edge (52) of shelf (2), and thereby aligned with a holder (12), and a slot (5). Each brace (1) is comprised of a rectangular piece of flexible plastic (50) secured to one side adjacent a lengthwise edge on each brace. One end of the flexible plastic (50) is aligned with the forward edge of each brace (1), and the flexible plastic is then secured onto each brace by rivets (65A) in apertures (65) therethrough, or adhesive, or other suitable securing means may be used, and the inner ends of the flexible plastic terminating adjacent, and forward of the forward wall (39) of the cover (3). The flexible plastic (50), or other suitable resilient material can be used, is comprised for folding and securing the braces (1) onto the bottom surface of the shelf (2) and having suitable thickness, and apertures (59) for rivets (64A) access therethrough, for securing the braces (1) onto shelf (2) through apertures (64) thereby aligned with apertures (59) formed in the flexible plastic (50). The surface (53) of the flexible plastic (50) contacts the bottom surface of the shelf (2) and is secured thereon by rivets (64A), or other suitable means of securing braces (1) can be used. It is noted herein that this description is of the order of assembly of the present folding shelf cabinet. The shelf (2) having rods (7) made of metal of enough thickness and round shape, and each rod having structure comprising a downwardly extending bend in an innermost part of the rods, and aligned with the horizontally extended coaxial forward part of each rod. The rods (7) also comprise a bend adjacent the lower part of the downwardly extending part of each rod and being perpendicular to the downwardly extending part and formed in a direction opposite the bend in the lower part of the opposite rod, these opposite portions being adjacent the inner ends of the rods and the same parts having a thread (7A) formed thereon. Round shaped threaded bushings (62), made of metal of enough thickness or other suitable material can be used, having flat side surfaces of enough diameter so that the inner side surfaces of each bushing (62) contacts enough of the inner and outer surfaces of the parts of the walls (45) adjacent the edges of the slots (45A) comprised in the brackets (8). One bushing (62) is threaded onto the innermost end of the thread comprised on a first rod (7) and one of the same bushings is then threaded onto the inner part of the thread (7A) comprised on the opposite rod (7). The threaded (7A) parts of rods (7) transversely project, starting from the outer surfaces of walls (45) into slots (45A) in brackets (8) therethrough. A bushing (26) without a thread and made of metal or other suitable material, is placed onto a central part of each threaded part (7A) of rods (7). A threaded bushing (62) is threaded onto each rod (7) and adjusted on the threads (7A) to the outer surfaces of walls (45) of brackets (8), and the outermost and innermost bushings (62) are then adjusted so that the rods in the brackets are pivotal in any part of the slots (45A). Brackets (8) are aligned with apertures (40) and secured to the outer surface of side walls (36) of cover (3), with the open side of each bracket (8) facing the adjacent walls (36) by rivets or other suitable means of affixing. Rods (7) are then pivotally swung downwardly, and shelf (2) is then positioned having braces (1) unfolded and supported in holders (12) and having the inner lengthwise edge (52) of shelf (2) contacting the top lengthwise edge of cabinet (4) so that rods (7) being horizontally pivotal, are then positioned contacting the closed inner end of the horizontal part of slots (45A) in brackets (8), so that the bent coaxial part of each rod transversely extend a proportional distance beyond the inner lengthwise edge (52) of shelf (2) for moving the rods with enough clearance provided thereby, and the rods are then pivotally swung upwardly so that the horizontally extended forward part of each rod contacts the bottom of shelf (2) and are secured thereon by screws in threaded apertures in brackets (61) in alignment with apertures (60) formed in shelf (2) therethrough, or other means of securing rods (7) onto the bottom of the shelf (2) can be used. The present shelf (2) having cooperative structure consisting of transverse fine grooves (66) formed parallel on the top and bottom edges of the transversely projecting inner parts of braces (1) whereby the grooves (66) effect a frictional fit within holders (12) thus resisting random forward motion of the inner projecting parts of the braces from support within holders (12). The holders (12) comprise cooperative transverse fine grooves (12A) formed parallel on the upper and lower walls within holders (12), and frictionally contact the grooves (66) on braces (1) with a slight brake effect. The shelf (2), while in a horizontally extended, unfolded position, is secured from unintended forward motion from holders (12), by spring latch (16) projecting into countersunk aperture (69) formed adjacent the inner lengthwise edge (52) on the bottom of shelf (2). As shelf (2) is pushed inwardly toward cabinet (4), the bottom part of, and adjacent, the inner edge (52) of shelf (2) slidably bears on the vertically positioned forward part of a flat-shaped steel spring latch (16). The vertical part of latch (16) projects vertically upward in space (38) between cabinet (4) and cover (3). The inner part of latch (16) comprises a bend, and projects downwardly a slight distance above shelf (25) within cabinet (4) and is affixed to rear wall (19) by rivets in apertures therethrough, or other suitable means can be used for affixing the inner part of latch (16). The forward part of latch (16) contacts a transversely projecting forward part of a bar (34) of flat shape and made of metal of enough thickness. The transversely projecting forward end of the bar (34) being of enough width, and is positioned rearward of the vertical part of the spring latch (16) and contacts the top surface of the spring adjacent the vertical part thereby. The inner part of bar (34) being parallel and adjacent the lengthwise edge of the horizontal inner part of the spring and extends inwardly to rear wall (19) and projects in a formed access slot (34A) in rear wall (19) therethrough, whereby the inner end of bar (34) projects into space (18) and being in alignment and thereby affixed to the adjacent end of a pivotally mounted handle (17) on the rear wall (19) of cabinet (4) in space (18). Access for use of the handle (17) is provided through the handle (17) access clearance slot (29), thereby comprised to be cooperative with clearance space (18) adjacent posts (23). The handle (17) and latch (16) assembly is best shown in FIGS. 7, 15, and whereby the inner end part of bar (34) is affixed to handle (17) by a screw positioned through the top of bar (34) in an aperture (not shown) therethrough, and whereby the screw is secured in a threaded aperture (not shown) in the adjacent end of the handle (17) or other suitable means for securing the bar (34) to the handle (17) can be used. To release the shelf (2) from the latched position on cabinet (4), the user pushes the handle (17) downwardly so that the bar (34) is pushed upwardly at the inner end of the bar, by the adjacent end of the handle (17), whereby, the top surface of bar (34) contacts the top and bottom edges of slot (34A) whereby enough leverage is provided so that the forward end part of bar (34) swings downwardly and whereby the extending part of the bar contacting the top surface of spring latch (16) thereby pushes the forward part of latch (16) downwardly so that the vertical part of the latch is pushed downwardly from contact within counter-sunk aperture (69) therefrom, in the bottom surface of shelf (2), while the user simultaneously pulls the shelf (2) forwardly of cabinet (4) and cover (3), and thereby pivotally swings shelf (2) upwardly and/or downwardly to a vertically folded position. As shelf (2) is pulled forwardly, the round edges of the threaded bushings (62) slidably bear on the top surfaces of bottom walls (43) of brackets (8) shown on horizontal lines (58) in FIG. 12, and stop at the inner surface of the forward walls (41) of brackets (8) after shelf (2) and braces (1) are moved forward of holders (12) and the cover (3), whereby, the braces are foldable in the direction of surfaces (54) of flexible plastic (50), or any suitable flexible material may be used, therefore, the self-resilience of the flexible plastic tending toward a straightened position, pulls braces (1) into a partially folded position, thus comprising a convenience for partially folding a series of braces (1) simultaneously, as the user pivotally swings shelf (2) downwardly, the partially folded braces contact the forward surface of cover (3) and therefore, the folding of the series of braces is completed as the shelf (2) pushes the braces into a vertically folded position as in FIG. 1 in the drawing. Cover (3) is then pivotally swung upwardly and supported in a horizontally extended position by latches (37) comprised of a vertical slot (37A) formed starting in the top edge and downwardly extending a slight distance from the top edge and having a closed lower end, and the same latches secured to a part adjacent the outermost ends of the forward edge of shelf (25) of cabinet (4). The user holds cover (3) in a horizontal position and pushes the slidably affixed latch (37) through clearance spaces (37C) formed in the upper part of side walls (20) of cabinet (4), so that the latches (37) transversely extend a slight distance beyond the side walls (20), and aligned so that the closed end of the slots (37A) support the inner edge part of walls (36) of cover (3), in a horizontally extended position. Cover (3) is simultaneously secured in a vertically closed position as the bottom edges of parts of the braces (1) contact the closed lower ends of slots (5) comprised in cover (3), therefore, the braces (1) are cooperative analogous to latches, thereby resisting vertically upward swinging motion of the cover (3), for securing cover (3) in a vertically closed position. Shelf (2), with braces (1) being in a folded position, and the clearance spaces (10), so that rods (7) are carried forwardly as shelf (2) is pulled forward of the cabinet (4) and cover (3), and then pivotally swung downwardly into a vertically folded position, are shown in FIGS. 1, 2. Shelf (2), being in a horizontally extended position, and clearance spaces (11), and the position of rods (7) after shelf (2) is unfolded, are illustrated in FIG. 3. The rods (7) being adjustable through clearance spaces (44) comprising the open tops of brackets (8), when needed, to adjust shelf (2), and braces (1) into re-alignment with slots (5) in cover (3), and with holders (12) in cabinet (4). The bottom surface of shelf (2) having indentations of varied thickness (13) of the material of construction for reinforcing the shelf (2), to resist bending shelf (2), are shown in FIG. 5. Each holder (12) structure comprises open forward and inner ends, so that the inner ends of the braces (1) transit within holders (12) and stop at rear wall (19) of cabinet (4). The extending forward ends of holders (12) comprise stops, whereby, the inner surface of the forward wall (39) of cover (3) contacts the forward ends of the holders, thereby resisting and preventing inward bending of the cover (3) while the cover (3) is in a vertically closed position. The following, is a description of a modified form of folding shelf for cooperative use with the aforedescribed cabinet (4) and cover (3), in combination: The present invention comprises a folding shelf indicated by the letter (B) which follows the same reference numeral (2) and comprises folding shelf (2B), preferably made of molded rigid plastic of enough thickness, and having compartments (71B) having vertical walls (81B) rigidly connected to a rear wall (88B) and to a bottom wall (70B), and to the bottom surface of shelf (2B), which also comprises the top wall of the compartments thereof. The central walls (81B), being longer in length than the outermost walls (81B) so that the formed inner end parts of the central walls (81B) transversely project in rear wall (88B) therethrough, and thereby these projecting inner end parts of the central walls are analogous to rigid braces that are not foldable and are indicated by reference number and letter (1B) and comprise transverse fine grooves (66B) formed parallel on the top and bottom edges for frictionally fitting with a slight clearance within holders (12) within cabinet (4), and having rods (7B), with the inner parts of the rods transversely projecting in the rear wall (88B) of the outermost compartments (71B) therethrough. The forward ends of the walls (81B) terminate a slight distance rearward of, and, adjacent the forward lengthwise edge of shelf (2B) and the bottom wall (70B). Shelf (2B) comprises the top wall of compartments (71B) and comprises more depth than bottom wall (70B) to provide inner lengthwise edge (52B). The inner ends of walls (81B) being in alignment with bottom wall (70B) and rear wall (88B). In FIG. 17, (92B) indicates an inner end (1B) of a central wall (81B) supported in a holder (12). The bottom wall (70B) comprises clearance spaces (93B) formed in the inner lengthwise edge and the rear wall (88B) for clearing the upper parts of brackets (8B) when folding and unfolding shelf (2B). Rear wall (88B) is formed continuous around the spaces and occupy a part of the outermost compartments (71B), therefore, these compartments are comprised of less storage space than the central compartments (71B). The forward end parts of rods (7B) are secured parallel and outermost of the central walls (81B); the projecting inner parts (1B) and the outermost end walls (81B); onto the bottom surface of shelf (2B) by screws in threaded brackets (61B), illustrated in FIG. 7, or other suitable means of securing the rods may be used. The rear wall (88B) of compartments (71B) contacts the forward surface of wall (39) of the cover (3) while shelf (2B) is in a horizontally extended position. The bottom surface of shelf (2B) comprises varied thickness (72B) of the material of construction, illustrated in FIG. 17 to provide clearance space (91B) so that the inner lengthwise edge (52B) of shelf (2B) clears and contacts the ledges (28A) formed in the top edges of side walls (20) of cabinet (4), and illustrated in FIG. 17, and simultaneously clears the tops of brackets (8B) and parts of the inner lengthwise edge (52B) clears, and contacts ledges (28) atop holders (12). The forward lengthwise edge of shelf (2B) comprises a clearance space (85B), whereby less material of construction is used when making shelf (2B). Forward parts of walls (81B) having a formed slot comprised as a cooperative part of groove (74B), thereby providing clearance spaces (87B) for access clearance of the top wall (76B) and bottom wall (77B) of a slidable cover (75B). Clearance space (85B) is provided so that the forward parts of all the walls (81B) are clear of the top wall (shelf 2B) and provide access clearance space for the cover (75B). The inner projecting parts (1B) of the central walls (81B) are prevented from random forward motion from support within holders (12) by frictional brake effect as the bottom edges of the inner parts (1B) of the central walls (81B) slidably bear on the closed lower ends of the slots (5) in cover (3) when shelf (2B) is pushed inwardly and pulled forwardly, when in use, as friction slows the inner parts (1B). The aforedescribed friction effect simultaneously effects cooperativeness with frictional grooves (66B) comprised on the top and bottom edges of the projecting inner parts (1B) of central walls (81B) and the frictional grooves (12A) comprised on the top and bottom walls within holders (12) while shelf (2B) is supported by the parts (1B) in a horizontally extended unfolded position for supporting books and the like, when stored on the top surface of shelf (2B). The compartments (71B) are comprised for storing small radios; small books and the like. A sectional view of shelf (2B) is illustrated by (72B) in FIG. 17. The forwardly extending parts of the walls (81B) comprise transverse formed grooves (74B) on the top and bottom edges adjacent the forward ends on the same walls. The grooves (74B) are aligned and fit the extended parts extending lengthwise on the inner top and bottom edges (79B) of the slidable cover (75B) having a top wall (76B), a bottom wall (77B) and a forward wall (78B) shown in FIG. 17. Top wall (76B) and bottom wall (77B) terminate adjacent the central part of the cover (75B) whereby, the same cover consists of two sections pivotally connected, whereby, the forward wall (78B) comprised on each section of the cover (75B) overlapp, so that the parts adjacent, and, including the inner lengthwise ends of the forward walls (78B) are in contact and have flat surfaces in alignment with an aperture formed in each of the forward walls therethrough, and thereby secured by a rivet (not shown) and handle (84B). The same rivet being loose enough so that the two parts of the cover (75B) are pivotal. The handle (84B) is preferably made of molded rigid plastic, or other suitable material, and is secured onto the forward end of the rivet by a threaded bolt secured onto the handle, and the bolt is then secured in the rivet aperture therethrough by a threaded nut. The projecting edge (79B) of each part of the cover (75B) extends downwardly from the inner top edge (80B) of the top wall (76B) and the lower edge (79B) extends upwardly from the inner edge (80B) of the bottom wall (77B). When shelf (2B) is in use close to a corner of a room, or adjacent furniture, the user can slide the cover (75B) to either outermost end of the compartments (71B) so that the pivotal rivet and handle (84B) is at a distance slightly beyond either outermost end of shelf (2B) and the compartments (71B) after a first part of the cover is pivotally swung downwardly, and also can be pivotally swung upwardly to clear adjacent walls of rooms, or furniture, thus providing clearance space for the cover which can be removed or left in the access and support grooves (74B), as in FIG. 17. The cover (75B) is preferably made of molded rigid plastic of enough thickness or other suitable material can be used. The grooves (74B) support the part adjacent, and including the projecting lengthwise edges (79B). The parts of the forward ends of walls (81B) being thick enough to support the cover (75B) and prevent it from bending, before, and after shelf (2B) is pivotally swung downwardly into a vertically folded position. The stored contents of the compartments (71B) are thereby supported on the cover (75B) being in a horizontal position, as the shelf is in the pivotally swung down, vertically folded position. The position of rods (7B), in the vertical parts of the slots (45A) in brackets (8B), and the projecting inner ends of central walls (81B) contacting the top surface of cabinet (4), before the cover (3) is opened, is illustrated in FIG. 19. The position of rods (7B); the projecting inner end parts of the central walls (81B); as the cover (3) is in an open position, are illustrated in FIG. 20. The slots (5) in cover (3) support the projecting inner end parts of central walls (81B) by being in contact with the bottom edges of the projecting inner parts of the central walls, and the closed lower ends of the slots (5) thereby supporting shelf (2B) in a vertically supported position atop the cabinet (4) as the projecting inner ends of the central walls (81B) contact the top surface of the cabinet (4), simultaneously, and are supported atop the cabinet as shown in FIG. 20. The clearance space (85B) is provided adjacent the forward lengthwise edge of shelf (2B) as access for the top wall (76B) and the bottom wall (77B) of the cover (75B) as illustrated in FIG. 17. The top wall (76B) of the cover (75B) contacts parts of, and adjacent, the forward lengthwise edge (82B) of shelf (2B), indicated by reference character (86B) in FIG. 17. Clearance space (87B) comprised between the bottom of the forward ends (73B) of all the walls (81B) and the bottom wall (70B) of the compartments (71B) is for access clearance of the bottom wall (77B) of the cover (75B). The reinforced area (89B) of shelf (2B); the slidable cover (75B) positioned (90B) adjacent an outermost end of compartments (71B) and shelf (2B); are indicated in FIG. 17. Reference (91B) in FIG. 17, shows the inner edge (52B) of shelf (2B) contacting the forward top edge of cabinet (4), and parts of the inner edge (52B) of shelf (2B) contacting the tops of the ledges (28) of the holders (12), and the tops of brackets (8B) and the top forward edge of the side walls (20) of cabinet (4). Brackets (8B) and the side walls (20) of the cabinet (4) are not shown in FIG. 17. A part of the cover (75B) pivotally swung down is shown by reference (83B) in FIG. 17. The inner ends of the outermost walls (81B) are in alignment with bottom wall (70B) and the rear wall (88B).

Having described this invention, what is claimed is:

1. A folding shelf cabinet which comprises a cabinet having an open front and including cabinet side walls, a cabinet bottom wall, a cabinet top wall and a cabinet rear wall, the said walls defining an interior space in communication with the open front;

a cover movable between a first position and a second position to overfit the open front in the first position, the cover having cover side walls to which are attached brackets including L-shaped slots, a cover bottom wall, and a cover forward wall, which cover is pivotally connected to the cabinet side walls to optionally enclose the interior space; and a shelf comprising a forward shelf wall, an underside, and a pair of supporting rods attached to the shelf underside, the rods including a finger adapted for sliding and pivotal engagement within the L-shaped slots, whereby the shelf can be moved between a first position vertically oriented above the cabinet, to a second position horizontally oriented above the cabinet to a third position vertically oriented alongside the cabinet.

2. The folding shelf cabinet of claim 1 comprising means to support the shelf in a position horizontal to the cabinet.

3. The folding shelf cabinet of claim 2 whereby the means to support the shelf in a position horizontal to the cabinet comprises at least one holder, a brace, and a slot located respectively on the cabinet, shelf and cover, whereby placement of the brace through the slot and into the holder will maintain the shelf horizontal to the cabinet.

4. The folding shelf cabinet of claim 3 whereby the brace and holder are roughened along those surfaces which come into contact with each other when the brace is inserted within the holder, to enable them to frictionally engage.

5. The folding shelf cabinet of claim 2 whereby the means to support the shelf in a position horizontal to the cabinet comprises a spring latch.

6. The folding shelf cabinet of claim 1 and a spring latch affixed to the cabinet side wall to support the cover in an open position perpendicular to the cabinet.

7. The folding shelf cabinet of claim 1 and a semi-frame in contact with the cabinet to reinforce the cabinet along the top wall.

8. The folding shelf cabinet of claim 1 wherein the shelf is hollow and the forward wall consists of a slideable shelf cover.

9. The folding shelf cabinet of claim 1 which is fabricated of sturdy plastic.

10. The folding shelf cabinet of claim 1 which is fabricated of wood.

* * * * *